United States Patent [19]

Hager, Jr.

[11] 4,262,190

[45] Apr. 14, 1981

[54] CONVECTION CONTROL DEVICE FOR RADIANT HEATER

[75] Inventor: Nathaniel E. Hager, Jr., Lancaster, Pa.

[73] Assignee: Armstrong Cork Company, Lancaster, Pa.

[21] Appl. No.: 71,306

[22] Filed: Aug. 30, 1979

[51] Int. Cl.[3] ..... H05B 1/00

[52] U.S. Cl. ..... 219/345; 219/355; 219/354; 219/342

[58] Field of Search ..... 219/345, 342, 377, 354, 219/352, 355, 357, 405, 411, 344

[56] References Cited

U.S. PATENT DOCUMENTS

| | | | |
|---|---|---|---|
| 2,545,805 | 3/1951 | Callender | 219/345 |
| 3,265,858 | 8/1966 | MacGuire | 219/345 |
| 3,420,982 | 1/1969 | Hager, Jr. | 219/345 |
| 3,493,724 | 2/1970 | Wells | 219/345 |
| 3,525,850 | 8/1970 | Hager, Jr. | 219/345 |

FOREIGN PATENT DOCUMENTS

| | | | |
|---|---|---|---|
| 691329 | 7/1964 | Canada | 219/345 |
| 1066854 | 6/1954 | France | 219/345 |
| 1078795 | 11/1954 | France | 219/345 |
| 387828 | 2/1933 | United Kingdom | 219/345 |

*Primary Examiner*—B. A. Reynolds
*Assistant Examiner*—Bernard Roskoski

[57] ABSTRACT

A flat ribbon-type heater is subjected to convection loss of heat when air moves across the ribbon heater. This convection loss is minimized by providing a wall structure on either side of the ribbon heater. The wall height to ribbon width must be controlled to maximize the output of radiant energy output and minimized convection loss. Maximum efficiency occurs when the wall height(h) is equal to one half the width(w) of the ribbon heater.

Baffles may be placed along the length of the ribbon heater to minimize air current flow along the ribbon heater.

4 Claims, 2 Drawing Figures

CONVECTION CONTROL DEVICE FOR RADIANT HEATER

BACKGROUND OF THE INVENTION

1. Field of the Invention

The invention is directed to an electric heater and more specifically to a means for minimizing convection loss on a radiant heating element in an electric heater.

2. Description of the Prior Art

U.S. Pat. No. 3,525,850 discloses the type of radiant heater being used herein. Such a heater is subjected to convection loss when used particularly in a horizontal upward facing position, and the invention herein is specifically designed to minimize this convection loss.

U.S. Pat. Nos. 3,114,822 and 3,436,524 show that heating elements have been positioned in holders which would tend to provide a wall structure on either side of the heating elements. However, these heating elements are not particularly subjected to convection losses and the patents contain no teaching of the relationship of wall height to ribbon width in order to maximize radiant energy and minimize convection loss.

SUMMARY OF THE INVENTION

The invention is directed to a high intensity, quick response electrical resistance foil radiant heater which has a heating element in the form of a tranversely corrugated metallic foil ribbon adapted to be heated by the passage of electricity therethrough to a temperature in the range of about 1200°-1800° F. This ribbon is mounted on a thermally insulating backing for said ribbon. In order to minimize convection loss, wall means are provided adjacent the sides of the ribbon. These wall means have a height which is about ½ the foil ribbon width. The convection loss is particularly noticeable when the ribbon is heated to below 1500° F. at which temperatures convection heat transfer plays a significant role, and, therefore, the wall structure substantially minimizes energy loss due to convection.

When the heating ribbons are more than 1 inch in width are used with a wall structure, there may not be an air flow across the ribbons, but there is still the possibility of an air flow down along the ribbon. In order to minimize this air flow and the convection loss that results therefrom, the wall structure is used in combination with a plurality of perpendicular baffles to cut down the air flow both transversely of and along the ribbon heater.

DESCRIPTION OF THE PREFERRED EMBODIMENTS

In many applications where a ribbon heater such as that set forth in U.S. Pat. No. 3,525,850 is used, the energy output is purely radiative, particularly when the heater ribbon is aimed downward. Warm air near the ribbon cannot rise and, therefore, convection currents cannot develop to the extent that significant energy is diverted from the radiative process. Thus, the heating elements get sufficiently hot so that they can evolve by radiation essentially all the electric power dissipated. However, such is not the case when the above indicated foil element is aimed upward and is positioned above its insulative backing. Here the warm air may rise rapidly from the vicinity of the element and convection currents may be sizeable. In some cases, convection losses from the upwardly facing foil elements will not only waste up to 50% of the electrical energy but cause undesirable heating and degradation of a reflector and wiring components which may be positioned above the heating elements.

Figure 1:
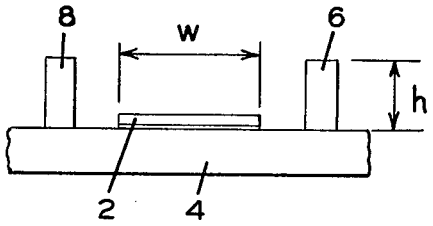
FIG. 1 is an end view of one embodiment of the invention herein.

The basic idea for restricting the convection currents is to place walls along both sides of the heating element as shown in FIG. 1 in such a manner as to restrict lateral flow of cool air required to replace the rising hot air. By this means, the whole convection process is impeded and a greater portion of the electrical power dissipated in the ribbon must be radiated. If the walls are too low, the convection process is not sufficiently impeded. If the walls are too high, the convection process is minimized, but the walls interfere with the radiant process except for those rays leaving nearly perpendicular to the ribbon.

By running a series of tests, it is possible to measure the efficiency of a ribbon heater such as that shown in U.S. Pat. No. 3,525,850, when used with walls adjacent thereto. As a result of the tests, it was found that a 0.50 inch ribbon provides greatest efficiency when the wall height is about 0.25 inches. When a ribbon of 0.25 inches was used, it was found that greatest efficiency was secured with a wall height of about 0.125 inches. With a ribbon of 1.0 inches wide, it was found that the greatest efficiency was secured with a wall height of 0.5 inches. Consequently, in all cases, the optimum wall height, that is the wall height that gives maximum efficiency for the heater, is about ½ the ribbon width. Looking at FIG. 2, when the ribbon 2 is placed on its thermal backing, it should also be provided with walls 6 and 8 which are of the same material as the thermal backing. The walls have been made of aluminum also, and any other material will work as long as it is not affected by heat. The relationship of the width w of the ribbon 2 to the height h of the wall should be in a relationship such that wall height is about ½ ribbon width in order to secure maximum radiant energy efficiency for the ribbon. This in effect means that convection losses have been reduced to a minimum.

It has also been learned that the importance of limiting convection loss is greater at lower ribbon temperatures than at higher ribbon temperatures. That is, because at higher temperatures in the order of 1500° F., radiant heat transfer is dominant and only a lesser fraction of the elements' energy is dissipated by convection. But, as one lowers the ribbon temperature, the net radiant output decreases with the cube of the ribbon temperature, while the convection loss changes only slightly. Therefore, the wall technique for maximizing radiant energy is most important for heaters which run with ribbons at relatively low temperatures.

Figure 2:
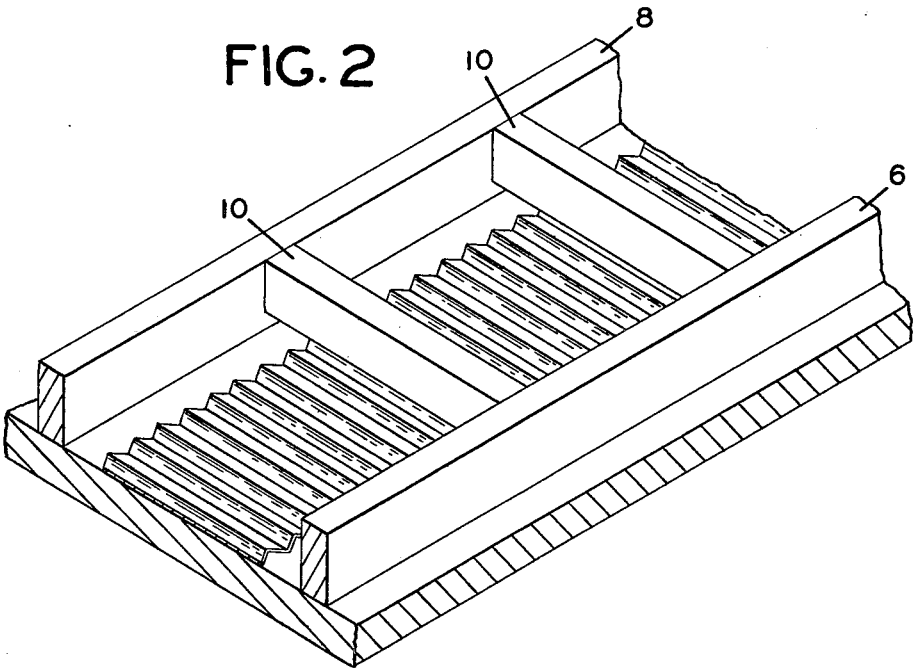
FIG. 2 is a perspective view of another embodiment of the invention herein.

Finally, it has been determined that the effect of the wall structure is less pronounced with a 1.0 inch ribbon than with narrower ribbons. This is probably because the space between the walls with the larger ribbon is now great enough so convection currents are free to move along the length of the ribbon instead of moving inward across the edges of the ribbon. In this case, further restriction of convection currents can be achieved by inserting a system of baffles perpendicular to the ribbon length, said baffles having the same height as the walls and being spaced at intervals equal to the distance between the walls. This structure is shown in FIG. 2 wherein the baffles 10 are positioned between the walls 6 and 8 in order to minimize convection currents moving along the length of the ribbon. In one specific example, using a 0.5 inch wide ribbon, it was found that the baffles can increase radiant efficiency by about 5% above the value obtained with the walls 6 and 8 alone.

What is claimed is:

1. A high intensity, quick response, electrical resistance foil radiant heater having a heating element in the form of a transversely corrugated metallic foil ribbon adapted to be heated by the passage of electricity therethrough to a temperature in the range of about 1200°–1800° F., a thermally insulated backing for said ribbon, the improvement being means limiting convection losses, said means comprising:

(a) said foil being positioned in a nearly horizontal plane with said backing being positioned therebelow, (b) vertical wall means positioned closely adjacent and along both edges of said horizontally positioned foil, and (c) said vertical walls having a height which is ½ the foil ribbon width.

2. A high intensity heater as set forth in claim 1 wherein said heater operates in a temperature range of about 1500° and below, and said wall means restricts inward flow of cool air to the foil and thereby lessens the loss of foil energy by convection.

3. A high intensity heater as set forth in claim 1 wherein the foil ribbon width is about 1 inch or greater and convection currents may be free to move along the length of the foil ribbon, the further improvement comprising:

(a) baffle means positioned perpendicular to said foil ribbon and positioned transversely along the length of said foil ribbon.

4. A high intensity heater as set forth in claim 3 wherein said baffles have the same height as the vertical wall means and are spaced apart at intervals equal to the distance between the said wall means.

* * * * *